US012559210B1

(12) United States Patent
Rosario et al.

(10) Patent No.: US 12,559,210 B1
(45) Date of Patent: Feb. 24, 2026

(54) SYSTEMS AND METHODS FOR ASSISTING OPERATORS OF MARINE VESSELS IN LOCATING COMPONENTS FOR ATTENTION

(71) Applicant: Brunswick Corporation, Mettawa, IL (US)

(72) Inventors: Lee Rosario, Rockledge, FL (US); Carrie A. Fodor, Cape Canaveral, FL (US); Charles D. Foss, Port Orange, FL (US)

(73) Assignee: Brunswick Corporation, Mettawa, IL (US)

( * ) Notice: Subject to any disclaimer, the term of this patent is extended or adjusted under 35 U.S.C. 154(b) by 161 days.

(21) Appl. No.: 18/590,586

(22) Filed: Feb. 28, 2024

(51) Int. Cl.
*B63H 21/21* (2006.01)
*B63B 45/04* (2006.01)

(52) U.S. Cl.
CPC ..... *B63B 45/04* (2013.01); *B63H 21/21* (2013.01)

(58) Field of Classification Search
CPC ..... B63B 79/40; B63B 45/04; B63H 21/21; B63J 2/02; B63J 3/04
See application file for complete search history.

(56) References Cited

U.S. PATENT DOCUMENTS 5,787,832 A * 8/1998 Spinka ..... B63B 43/14 114/123
7,150,664 B1 12/2006 Uppard et al.
7,255,616 B1 8/2007 Caldwell
7,441,189 B2 10/2008 Michaels
7,467,595 B1 12/2008 Lanyi et al.
8,803,711 B1 * 8/2014 Gonring ..... H05B 47/155 340/987
8,836,544 B1 9/2014 Balogh
8,944,865 B1 2/2015 Krabacher et al.
9,193,429 B1 11/2015 Langenfeld
10,191,490 B2 * 1/2019 Akuzawa ..... B63H 25/04
10,654,551 B1 * 5/2020 Doremus ..... B63B 1/246
10,967,946 B1 * 4/2021 Tuchscherer ..... B63H 20/10
11,600,184 B2 * 3/2023 Derginer ..... B63B 79/40
12,263,921 B1 * 4/2025 Pienta ..... B63B 1/32
(Continued)

OTHER PUBLICATIONS

Lyu et al., Sea-Surface Object Detection Based on Electro-Optical Sensors: A Review, 2022, IEEE, p. 1-27 (Year: 2022).*
(Continued)

*Primary Examiner* — Mcdieunel Marc
(74) *Attorney, Agent, or Firm* — Andrus Intellectual Property Law, LLP

(57) ABSTRACT

Systems and methods for assisting an operator of a marine vessel. The system includes a cover that covers a portion of the marine vessel, the cover having an external surface. A light element is operable to change an appearance of the external surface thereof. A controller is operatively coupled to the light element. The controller is configured to receive an input indicating that attention is recommended for a component, to determine whether the component is proximate to the cover, and, when the component is determined to be proximate to the cover, to operate the light element to change the appearance of the cover to thereby assist the operator in locating the component for which attention is recommended.

20 Claims, 5 Drawing Sheets

(56) References Cited

U.S. PATENT DOCUMENTS

| | | | | |
|---|---|---|---|---|
| 2012/0277941 | A1* | 11/2012 | Noffsinger | G08G 3/00 701/21 |
| 2019/0155287 | A1* | 5/2019 | Arbuckle | G08G 3/02 |
| 2020/0255104 | A1* | 8/2020 | Gonring | B63H 21/21 |
| 2022/0029420 | A1* | 1/2022 | Ledden | H02J 3/24 |

OTHER PUBLICATIONS

Hornor, Standard Marine Electrical Installations, 1915, IEEE, p. 1821-1855 (Year: 1915).*

Xiao et al., Traffic Pattern Mining and Forecasting Technologies in Maritime Traffic Service Networks: A Comprehensive Survey, 2019, IEEE, p. 1796-1825 (Year: 2019).*

Rogers et al., The ANN (assistant naval navigator) system, 2012, IEEE, p. 266-272 (Year: 2012).*

"Smart Surfaces: A New Frontier" accessed from https://www.cta.tech/Resources/i3-Magazine/i3-Issues/2022/May-June/Smart-Surfaces-A-New-Frontier on Dec. 19, 2023.

"New VW ID.7 Reveals Glow Paint Technology" accessed from https://www.youtube.com/watch?v=62SG0w0Mhww on Feb. 28, 2024.

"Lumilor" accessed from https://www.lumilor.com/ on Feb. 28, 2024.

* cited by examiner

SYSTEMS AND METHODS FOR ASSISTING OPERATORS OF MARINE VESSELS IN LOCATING COMPONENTS FOR ATTENTION

FIELD

The present disclosure generally relates to systems and methods for assisting operators of marine vessels, and particularly for assisting operators of marine vessels in locating components for attention.

BACKGROUND

The following provide background information and are incorporated by reference in entirety.

U.S. Pat. No. 8,836,544 discloses multifunctional displays for a marine vessel having a propulsion system, the displays depicting components of the propulsion system during a first operational and a second operation mode. A marine vessel icon has first and second icons depicting changes in characteristics of the first and second components. The icon changes position when the operational mode of the marine vessel changes.

U.S. Pat. No. 7,441,189 discloses a method of producing an instrumentation interface for a vehicle having a display device, which may include initializing a display format for the instrumentation interface in accordance with one or more characteristics of the vehicle. The method may further include collecting customization data to configure a display site defined by the display format of the instrumentation interface, and generating the instrumentation interface via the display device in accordance with the display format and the customization data for the display site.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure generally relates to a system for assisting an operator of a marine vessel. The system includes a cover that covers a portion of the marine vessel, the cover having an external surface. A light element is operable to change an appearance of the external surface thereof. A controller is operatively coupled to the light element, the controller being configured to receive an input indicating that attention is recommended for a component, to determine whether the component is proximate to the cover, and, when the component is determined to be proximate to the cover, to operate the light element to change the appearance of the cover to thereby assist the operator in locating the component for which attention is recommended.

In certain examples, the cover is a cowling of a marine drive configured to propel the marine vessel and the component is at least partially inside the cowling.

In certain examples, the light element is supported by the cover.

In certain examples, the light element is visible on the external surface when on and non-visible on the external surface when off.

In certain examples, the controller is configured to turn on the light element when the input corresponds to an overheating temperature detected on the marine vessel.

In certain examples, the controller is configured to turn on the light element when the input corresponds to an operator request for assistance locating the portion of the marine vessel covered by the cover. In further examples, the controller is configured to receive the operator request wirelessly from an external device.

In certain examples, the external surface is positioned apart from a helm of the marine vessel. In further examples, a display device is positioned at the helm, the display device being operatively coupled to the controller, the controller being configured to cause the display device to generate a display when the input relating to the portion of the marine vessel covered by the cover is received. In further examples, the display generated by the display device provides different information than the appearance of the external surface of the cover from the light element.

In certain examples, the cover is a removable section of flooring.

In certain examples, the appearance of the external surface changes in color via operating the light element.

In certain examples, the appearance of the external surface changes by displaying text via operating the light element.

In certain examples, the appearance of the external surface changes in brightness via operating the light element.

In certain examples, a speaker and/or vibration device is operatively coupled to the controller, the controller being configured to cause the speaker to produce a sound and/or the vibration device to generate vibration when the input is received and the component is determined to be proximate to the cover.

In certain examples, the controller is configured to receive the input from a sensor that measures at least one of temperature, pressure, smoke, electrical resistance, voltage, current, vibration, a presence of liquid, and a level of liquid.

Another aspect of the present disclosure generally relates to a method for assisting an operator of a marine vessel, the marine vessel having a cover proximate to a component of the marine vessel. The method includes receiving via a controller an input indicating that attention is recommended for the component and determining whether the component is proximate to the cover. The method further includes changing an appearance of the cover when the input is received and the component is determined to be proximate to the cover, where changing the appearance of the cover assists the operator in finding the component for which attention is recommended.

In certain examples, the appearance of the cover is changed by changing a brightness produced via a light element.

In certain examples, the component is one or a plurality of components, the cover is one of a plurality of covers that at least partially cover the plurality of components, respectively, and wherein the appearances of the covers within the plurality covers are changed via controlling a plurality of light elements associated therewith, respectively.

Another aspect of the present disclosure generally relates to a system for assisting an operator of a marine vessel having a helm. The system includes a first cover that covers a first region away from the helm and a second cover that covers a second region away from the first region and from the helm, the first cover and the second cover each comprising an external surface. Light elements are positioned proximate the first cover and the second cover, respectively, and operable to change an appearance of the external surface corresponding thereto. A controller is operatively coupled to the light elements, the controller being configured to receive an input indicating that attention is recommended for one of the first region and the second region, to determine for which of the first region and the second region the attention is recommended, and to control one of the light elements to change an appearance of the external surface of one of the first cover and the second cover covering the one of the first region and the second region for which the attention is recommend, wherein changing the appearance assists the operator in locating the one of the first region and the second region for which the attention is recommend.

It should be recognized that the different aspects described throughout this disclosure may be combined in different manners, including those than expressly disclosed in the provided examples, while still constituting an invention accord to the present disclosure.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

Figure 1:
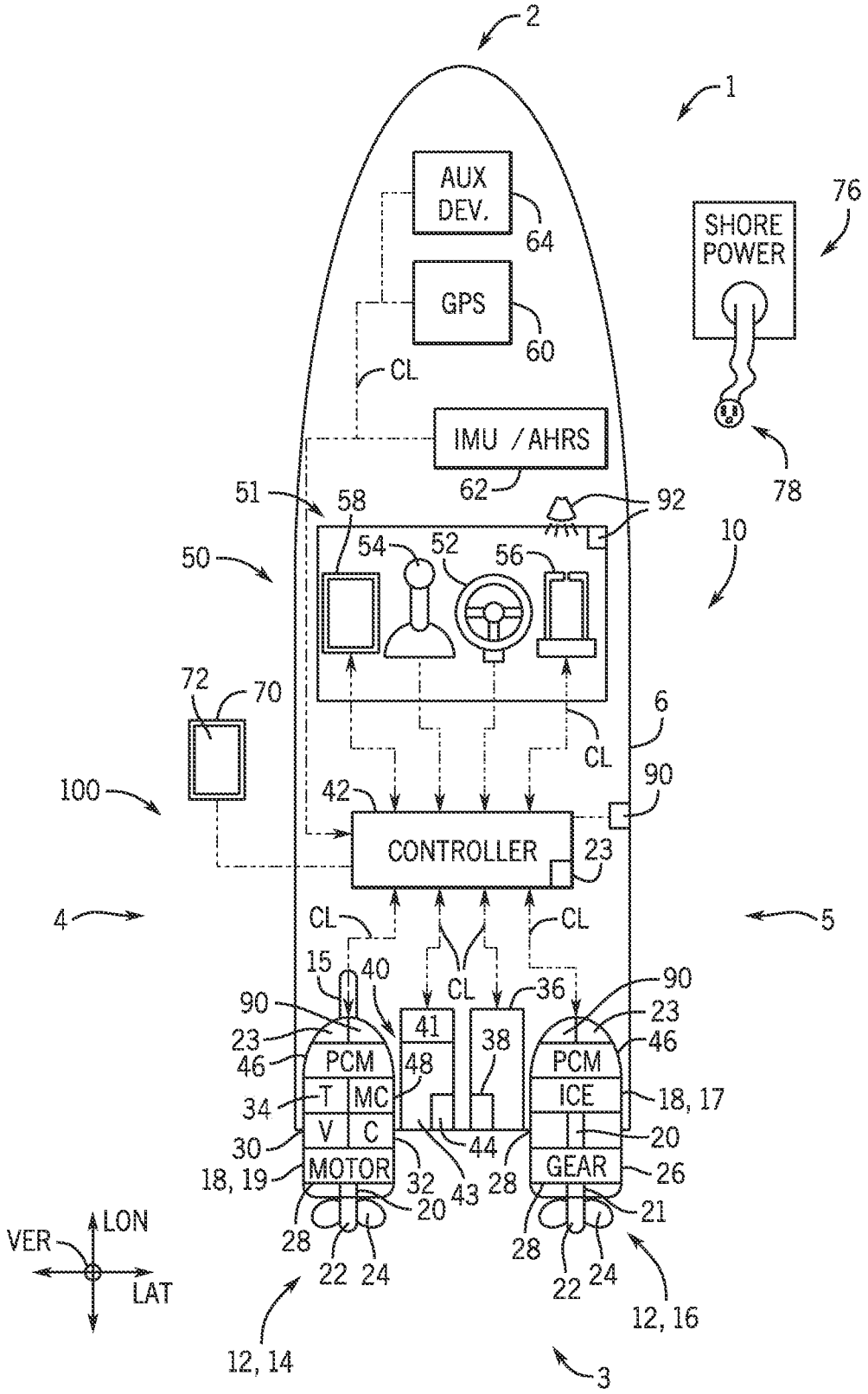
FIG. 1 is a top view of a marine vessel incorporating one embodiment of a system for assisting an operator according to the present disclosure.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Through experimentation and development, the present inventors have recognized shortcomings in the systems and methods known in the art for communicating information regarding a marine vessel to operators, guests, and emergency personnel (collectively referred to as "operators" for simplicity). For example, alarms, warnings, and other notifications are often ambiguous and require substantial time to not only determine that a components of a marine vessel should receive attention, but also which component and where that component is located within the marine vessel. As marine vessels become larger, more sophisticated, and/or more complicated, the number of components within the marine vessel also tends to increase. In some cases, there may be multiple components of the same type, not all of which require attention (e.g., only one of multiple batteries requiring attention).

Moreover, for weight distribution, manufacturing, safety, and other reasons, these components are often distributed in multiple regions of the marine vessel. The number of components may also increase as more electrical power is provided onboard, such as for powering electric propulsion and/or for to meet greater demand for house power (e.g., for battery chargers, HVAC, refrigerators, pumps, water makers, water heaters, lighting, entertainment, communication, and/or the like). In the case of a marine vessel, the operator cannot simply "pop the hood" to provide access for all components. Rather, the operator must hunt around and often consult the operator's manual to determine whether which component or components are at issue, and where these various components are located within the marine vessel. By way of example, even if an operator recognizes that attention is needed for a battery, for example to turn it off for maintenance, this battery may be one of many distributed between the bow and stern, port and starboard, under seats, below floor hatches, in a bilge, and/or elsewhere. Additionally, the operator may not even be aware that multiple batteries are onboard the marine vessel in differing locations. Additional examples of situations requiring attention include failing bilge pumps or faulty engine components.

In view of this, the present inventors have developed the presently disclosed systems and methods for assisting operators of marine vessels, and particularly for assisting operators of marine vessels in locating components for which attention is recommended. It should be noted that the term "recommended" shall be interpreted broadly to include any status, condition, urgency, and the like accompanying attention. By way of non-limiting example, this includes circumstance in which attention is optional for awareness or training, attention is desired by the operator (e.g., the operator requests assistance in locating a component), attention is required (e.g., corresponding to a warning or notification as conventionally known), or others. In other words, "recommended" is used for simplicity and is non-limiting on the urgency or necessity for providing such attention.

However, in some examples the urgency or necessity may impact the manner in which assistance is provided to the operator. For example, the color, brightness, symbol, text, volume, sound patterns, or durations may vary depending on the component, the urgency of providing attention to the component, and/or the necessity of providing attention to the component, each of which further assist the operator.

It should also be noted that the term "component" shall be interpreted broadly to include anything that the operator may be locating, such as a fuse box or even a particular fuse within a fuse box, a battery, an engine, an entire marine drive, an oil level gauge, an oil level fill port, a bilge pump, a fan, a pressure gauge, a dipstick, a switch, a valve, a fluid and/or electrical connection, communication equipment, a manual, safety equipment such as a first aid kit, an EPIRB, a life preserver, a life raft, flares, and/or survival suit, fill ports for water or fuel, and/or accessories such as fishing gear, oars, or an anchor. As such, the component may be a region of the marine vessel, for example a bilge, a storage locker, the region below a removable section of floor or a hatch, or the region under a cowling of a marine vessel, by way of example. The present disclosure also refers to "covers" as anything having an external surface and that at least partially covers something. The cover may partially cover a component discussed above or something else, such as a door, seat, removeable section of floor, a section of fiberglass wall within the marine vessel, engine lid, or a cowling, by way of example. It should be noted that a component may be referred to in a manner in which the cover that at least partially covers a portion of the component is part of that component, such as a marine drive as the component and its cowling as the cover that covers at least a portion of the marine drive (e.g., subcomponents inside that marine drive).

FIG. 1 depicts an example of a system 10 for assisting operators of a marine vessel 1 according to the present disclosure. The marine vessel 1 has a hull that extends between a bow 2 and a stern 3 in a longitudinal direction LON, between a port side 4 and a starboard side 5 in a lateral direction LAT that is perpendicular to the longitudinal direction LON, and between a bottom and a top in the vertical direction VER (shown as walls 6). The vertical direction VER is perpendicular to both the longitudinal direction LON and the lateral direction LAT. The hull is configured to float in a body of water in a conventional manner.

The marine vessel 1 is configured to move within the body of water in a direction instructed by an operator via a steering control system, or by a guidance system configured to automatically control steering of the marine vessel to steer the vessel toward a predetermined location or global position. The marine vessel 1 may be steered in a conventional manner, such as by controlling a marine drive or a rudder via a steering actuator. Additional information regarding exemplary steering actuators is provided in U.S. Pat. Nos. 7,150,664; 7,255,616; and 7,467,595, which are incorporated by reference herein.

The marine vessel has a propulsion system with at least one marine drive 12 configured to propel the marine vessel through the water. While the propulsion system is generally described herein as using motors or engines as powerheads to generate thrust in the water, the present disclosure is also applicable for marine vessels that are moved in the water via sails, oars, pedals, and/or other mechanisms. For demonstration purposes, the present marine vessel 1 is shown to have two different marine devices 12, specifically an electric marine drive 14 steerable by a tiller handle 15 with a throttle grip, and a gasoline powered marine drive 16 (e.g., steerable by conventional steering actuators). While the marine drives 12 are shown as outboard motors, these could instead be inboard motors, stern drives, pod drives, and/or jet drives. Each marine drive 12 includes a powerhead 18. The powerheads 18 may be internal combustion engines (ICE) 17 (e.g., gasoline or diesel engines, gasoline for the gasoline powered marine drive 16), electric motors 19 (e.g., for the electric marine drive 14), and/or a hybrid thereof. Examples of powerheads 18 for electric marine drives include, for example, a brushless DC motor, a DC brushed motor, an AC brushless motor, a direct drive, a permanent magnet synchronous motor, an induction motor, or any other device that converts electric power to rotational motion. In certain embodiments, the powerheads 18 include a rotor and a stator in a known configuration.

Each powerhead 18 has a drive shaft 20 that rotates during operation. Each drive shaft 20 is connected in a torque-transmitting relationship with a propeller shaft 22 that rotates a propeller 24 connected thereto. In this manner, each powerhead 18 rotates a corresponding propeller 24 to generate thrust in the water. As will be known to one of ordinary skill in the art, the propeller 24 may include one or more propellers, impellers, or other propulsor devices and that the term "propeller" may be used to refer to all such devices.

In certain configurations, the drive shaft 20 of the powerhead 18 is connected to the propeller shaft 22 via a gear system 26 or transmission. In this case the gear system 26 or transmission receives rotation from the drive shaft 20 as an input and selectively rotates an output shaft 21 as an output. In particular, the gear system 26 is operable to adjust conversion of the rotation and/or to disconnect the propeller shaft 22 from the drive shaft 20 therethrough, as is sometimes referred to in the art as a "neutral" position in which rotation of the drive shaft 20 is not translated to the propeller shaft 22. The gear system 26 may also shift between "forward" and "reverse" positions, which changes the direction in which the propeller shaft 22 is caused to rotate by rotation of the drive shaft 20. Various gear systems 26, or transmissions, are well-known in the relevant art. In other examples, the powerhead may directly connect to the propeller shaft 22 such that rotation of the drive shaft 20 is directly transmitted to the propeller shaft 22 at a constant and fixed ratio (e.g., for an electric marine drive 14). Shifting a marine drive 12 from neutral to either forward or reverse, or to begin generating propulsion generally, may also be referred to as "engaging" the marine drive 12. Likewise, disengaging the marine drive 12 corresponds to causing the marine drive 12 to no longer generate propulsion, such as by stopping rotation of the powerhead 18 and/or transitioning into a neutral position.

With continued reference to FIG. 1, the marine drives 12 further include powerhead sensors measuring various aspects of the powerheads 18, including a speed in which a powerhead 18 is operating. In certain examples, the powerhead sensors are speed sensors 28 that measure a rotational speed of the drive shaft 20, the output shaft 21, and/or the propeller shaft 22. The shaft rotation sensor 28 may be a Hall-Effect sensor or another rotation sensor that measures the rotational speed in rotations per minute (RPM) in a manner known in the art (e.g., using capacitive or inductive measuring techniques).

Other examples of powerhead sensors, particularly in the case of an electric marine drive 14, include a voltage sensor 30, a current sensor 32, and/or a torque sensor 34 configured to sense an input voltage to the electric motor 19, an input current to the electric motor 19, and a torque output of the electric motor 19, respectively. Accordingly, power delivered to the electric motor 19 can be calculated based on the measurements of the voltage sensor 30 and the current sensor 32. In certain examples, one or more of the parameters, such as the speed, torque, or power to the electric motor 19, may be calculated based on other measured parameters or characteristics of the various sensors. For example, the torque may be calculated based on power characteristics in relation to the rotation speed of the electric motor. These measurements and calculations can then be used for monitoring and controlling the marine vessel 1, including the system 10 and/or the powerheads 18. Other sensors 23 aboard the marine vessel generally may include liquid level sensors (e.g., water, fuel, oil), pressure sensors, temperature sensors, smoke and/or gas detectors, sensors that detect the presence of water, vibration sensors, noise sensors, light sensors, position sensors (e.g., a pole light being installed, doors being opened/closed, an anchor resting on a pressure plate, etc.), voltage, current, resistance, and/or state of charge sensors, and/or sensors generally known in the art.

The marine drives 12 are connected so as to receive energy from one or more energy sources. In the case of a gasoline powered marine drive 16, the energy is gasoline and the energy source is a fuel tank 36 fluidly connected to the ICE 17 in a conventional manner. A fuel level sensor 38 is configured to measure the amount of fuel remaining in the fuel tank 36 in a conventional manner (e.g., a Hall effect sensor that measures a position of a float within the fuel tank 36).

In the case of an electric marine drive 14, the energy is electrical power, and the energy source is a power storage system 40. The power storage system 40 stores electrical energy for powering the electric motor 19 and is rechargeable via a charger 41 that receives power from an external power connection. In certain examples, the charger may provide hundreds or even thousands of watts depending on the storage capacity of the power storage system. While the present disclosure generally refers to the external power connection as being a conventional source of shore power, this could also or alternatively be solar panels, wind vanes, water wheels, and/or other sources of power. Various power storage devices and systems are known in the relevant art. The power storage system 40 may be a battery system including one or more batteries or banks of batteries. For example, the power storage system 40 may include one or more lithium-ion (LI) battery systems, each LI battery comprised of multiple battery cells 43. In other embodiments, the power storage system 40 may include one or more lead-acid batteries, fuel cells, flow batteries, ultracapacitors, and/or other devices capable of storing and outputting electric energy. By way of example, this may include marine batteries in the group sizes BCI 24, 27, 31, and/or 34.

The amount of energy available within the energy source for operating the marine drives 12 may also be referred to as the "remaining energy". By way of example, this may be measured in kilowatt-hours, amp-hours, or other electrical measures in the case of electrical energy stored in energy sources, and/or as a volume such as liters or gallons in the case of energy stored in fuel tanks 36. It should be recognized that these measures may also be represented in other forms or units, such as a portion of maximum capacity (e.g., state of charge such as 55% charge remaining, 40% of fuel remaining), in terms of time or "time to empty" at a given energy consumption (e.g., 15 minutes remaining), distance or "distance to empty" at a given energy consumption (e.g., 2.5 miles remaining) or other measures relating to the amount of energy that remains within the energy source for use by the marine drives 12. Techniques for determining the remaining energy of electrical and fuel-based energy sources are well-known in the art and thus not described further here.

With continued reference to FIG. 1, the marine vessel 1 includes a control system 100 that controls the system 10 and other systems and devices of the marine vessel. The control system 100 may include a plurality of control devices configured to cooperate to provide the method of controlling the marine propulsion system described herein. For example, the control system 100 includes a central controller 42, a battery controller (BC) 44, a propulsion control module (PCM) 46, and one or more motor controllers 48, trim controllers, steering controllers, etc. Other controllers are also contemplated, such as a charging controller within the charger 41. The different controllers 44, 46, 48, 42 and may be communicatively connected via communication links CL, which may be as a communication bus such as a CAN bus or a LIN bus, or by single dedicated communication links between components. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected. In certain embodiments, the controller 42, battery controller 44, and PCM 46 are contained entirely within the marine drive itself (e.g., an electric marine drive).

Each controller may comprise a processor and a storage device, or memory, configured to store software and/or data utilized for controlling and or tracking operation of the electric propulsion system 2. The memory may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output (I/O) system provides communication between the control system 100 and peripheral devices.

In certain embodiments, various sensing devices 28, 30, 32, 34, 38, and/or 44 may be configured to communicate with a local controller, such as the motor controller 48, a propulsion control module PCM 46, or battery controller 44. In other embodiments, the various sensing devices 28, 30, 32, 34, and/or 38 may communicate with the central controller 42, which may permit eliminating one or more local controllers. In the example of FIG. 1, the voltage sensor 30 and the current sensor 32 may be communicatively connected to the motor controller 48 to provide measurement of the voltage supplied to the motor and current supplied to the electric motor 19. The motor controller 48 is configured to provide appropriate current and or voltage to meet the demand request for controlling the electric motor 19. For example, a demand input may be received at the motor controller 48 from the central controller 42 (shown here via a propulsion control module 46) such as based on an operator demand at a helm input device. The motor controller 48, voltage sensor 30, and current sensor 32 may be integrated into a housing of the electric motor 19. In other embodiments, the motor controller 48 may be separately housed, as well as the propulsion control module 46.

Each electric motor 19 may be associated with its own motor controller 48 configured to control power to the electric motor, such as to the stator winding thereof. The motor controller 48 is configured to control the function and output of the electric motor 19, such as controlling the torque outputted by the motor, the rotational speed of the electric motor 19, as well as the input current, voltage, and power supplied to and utilized by the electric motor 19. In one arrangement, the motor controller 48 controls the current delivered to the stator windings via leads connected to the electric motor 19, which input electrical energy to the electric motor to induce and control rotation of the rotor.

As stated above, the system 10 of FIG. 1 further includes a battery controller 44 configured to monitor and/or control aspects of the power storage system 40. The battery controller 44 may further be configured to receive information from current, voltage, and/or other sensors within the power storage system 40, such as to receive information about the voltage, current, and temperature of each battery cell or group of battery cells 43 within the power storage system 40. For example, the battery controller 44 may receive inputs from one or more sensors within the power storage system 40, such as one or more voltage, current, and temperature sensors within a housing for the power storage system 40. As described above, voltage sensors 30 may be configured to sense voltage within the battery (such as cell voltage sensors configured to sense the voltage of individual cells or groups of cells in a LI battery) and one or more temperature sensors may be configured to sense a temperature within a housing of the power storage system 40 where one or more batteries or other storage elements are located. The battery controller 44 or other controller in the system is configured to calculate a charge level, such as a state of charge, of the power storage system 40.

With continued reference to FIG. 1, additional components are also provided in communication with the control system 100, each of which may function as an input thereto and/or output thereof. In the example shown, the controller 42 also receives input from and/or communicates with one or more user interface devices within a user interface system 50 via the communication links CL, which in some embodiments may be the same communication link as utilized for communication between the controllers 44, 46, 48, or may be a separate communication link. The user interface devices 50 in the exemplary embodiment include a steering wheel 52, a joystick 54, throttle levers 56, and a display device 58.

The steering wheel 52 and joystick 54 may be configured to receive user inputs in a conventional manner, which subsequently may communicate with the controller 42 to effectuate steering control over the marine vessel 1, such as by steering one or more marine drives 12, which is well-known and typically referred to as steer-by-wire arrangements. Other steer arrangements, such as steering cable systems arrangements, are well-known in the art and could alternatively be implemented.

Likewise, the throttle levers 56 may be configured to receive user inputs in a conventional manner (also referred to as receiving a requested speed or a demand request), including both a magnitude and a direction for generating thrust, which may be subsequently communicated with the controller 42. In particular, the throttle levers 56 may communicate with the controller 42 to effectuate control of the output of the powerheads 18 of the one or more marine drives 12, which is well-known and typically referred to as a throttle-by-wire arrangement. By way of example, rotating one of the throttle levers 56 in a forward direction away from its neutral, detent position could be interpreted as a value from 0% to 100% demand request that corresponds, via an input/output map such as a look up table, to control the output of the powerhead 18 for the corresponding marine drive 12. In the case of a gasoline powered marine drive 16, rotating the throttle lever 56 may effectuate control a throttle valve position (and in certain examples, the transmission being shifted for rotating the propeller in the forward direction). This may occur through communication between the central controller 42 and a propulsion control module 46. In the case of an electric marine drive 14, rotating the throttle lever 56 may effectuate control of how much power is provided to the electric motor 19 rotating in the forward direction. This may occur through communication with a motor controller 48 and/or propulsion control module 46.

The input/output map may provide that no power is provided to the electric motor 19, or that the throttle valves are closed to an idle position, when the throttle lever 56 is in the neutral, detent position (i.e., 0% demand request). Likewise, maximum power may be provided to the electric motor 19, or the throttle valves being fully open, when the throttle lever 56 is pushed forward to its furthest extent (i.e., 100% demand request). It should be recognized that the throttle lever 56 being pushed backwards to its furthest extent (e.g., −100% demand request) responds oppositely, generating a corresponding thrust in an opposite direction (which may involve shifting the transmission in a conventional manner).

The present disclosure also contemplates alternate configurations, such as marine drives having tiller handles for controlling steering and throttle (and in either electric, fuel-based, or hybrid configurations). Likewise, demand requests may be received other than from throttle levers or grips, for example from cruise control or auto-pilot operational modes known in the art.

The display device 58 is configured to display information for the user, such as a speed and direction of the marine vessel 1 moving through the water, engine RPMs, a depth of the water, and other conventional information. The display device 58 may also be configured to receive input commands relating to steering, thrust, and/or other functions of the marine vessel and/or marine drive. This includes the programming of destinations and waypoints for autopiloting. In particular, the display device 58 may be a multi-functional display device permitting touch-screen inputs from the user. It should be recognized that other input devices may also be provided, such as keyboards, trackpads, roller balls, and the like. In various embodiments, the display device 58 may be, for example, part of an onboard management system, such as the VesselView™ by Mercury Marine of Fond du Lac, Wisconsin.

The onboard management system may also or alternatively be controlled through an external device 70 that wirelessly communicates with the controller 42, such as a tablet or smartphone communicating via wireless protocols known in the art (e.g., Wi-Fi or Bluetooth®). The external device 70 may have a processor, storage device, and an input/output (I/O) system in the same manner as other controllers discussed above. The processor may be configured to execute an application stored in the storage device that enables the user to receive information from the controller 42 relating to the marine drives 12 and the marine vessel 1 more generally, to input a destination for propelling the marine vessel, and to provide input commands to the controller 42 for controlling the marine drives 12 and the marine vessel 1 more generally. By way of example, the external device 70 may be configured to operate an application such as the "Mercury Marine" App or the VesselView™ Mobile App each provided by Mercury Marine of Fond du Lac, Wisconsin. In each case, the applications allow the user to receive information and to provide input commands via a user interface 72 of the external device 70, such as via a touchscreen. In this manner, the external device 70 may also constitute a controller within the control system 100.

Other components may also communicate with the controller 42, such as a GPS system 60 configured to determine a current global position of the vessel, track vessel position over time, and/or determine vessel speed and direction of travel and to provide this information to the controller 42. Alternatively, or additionally, vessel speed may be measured by a speed-over-water sensor such as a pitot tube or a paddle wheel and such information may be provided to the controller 42. This communication may again be provided via CAN bus, LIN bus, or single dedicated communication links).

The marine vessel 1 may also include an inertial measurement unit (IMU) or an attitude and heading reference system (AHRS) (collectively shown as the IMU/AHRS 62). An IMU has a solid state, rate gyro electronic compass that indicates the vessel heading and solid-state accelerometers and angular rate sensors that sense the vessel's attitude and rate of turn. An AHRS provides 3D orientation of the marine vessel 1 by integrating gyroscopic measurements, accelerometer data, and magnetometer data. The IMU/AHRS 62 could be GPS-enabled, in which case a separate GPS system 60 would not be required. The IMU/AHRS 62 may communicate with the controller 42 in a similar manner to the GPS system 60.

In addition to the electric marine drive 14, the GPS 60, the IMU/AHRS 62, and other electrical devices are also powered by the system 10. In particular, the system 10 may further be configured to power auxiliary devices 64 on the marine vessel 1 such as a bilge pump, a cabin light, a stereo system or other entertainment devices on the vessel, a water heater, a refrigerator, an air conditioner or other climate/comfort control devices on the vessel, communication systems, navigation systems, or the like. These devices may be powered from batteries (which are in turn powered by a charger), or directly powered by an external power source.

With continued reference to FIG. 1, the marine vessel 1 has an external power connection 74 that is electrically coupled to the system 10, including to the charger 41 for charging the cells 43 within the power storage system 40. The external power connection 74 may vary in form but is generally configured for being electrically coupled to an external power source such as a shore power station 76, for example via a cable 78 having conventional flat blade electrical prongs. By way of example, the external power connection 74 may be a NMEA L5-30—Standard 30A shore power receptacle. FIG. 1 shows in embodiment in which the external power connection 74 is positioned at or near the helm 51. The cable 78 or other power carrying mechanisms may be electrically mated to the external power connection 74 in a manner known in the art.

Figure 2:
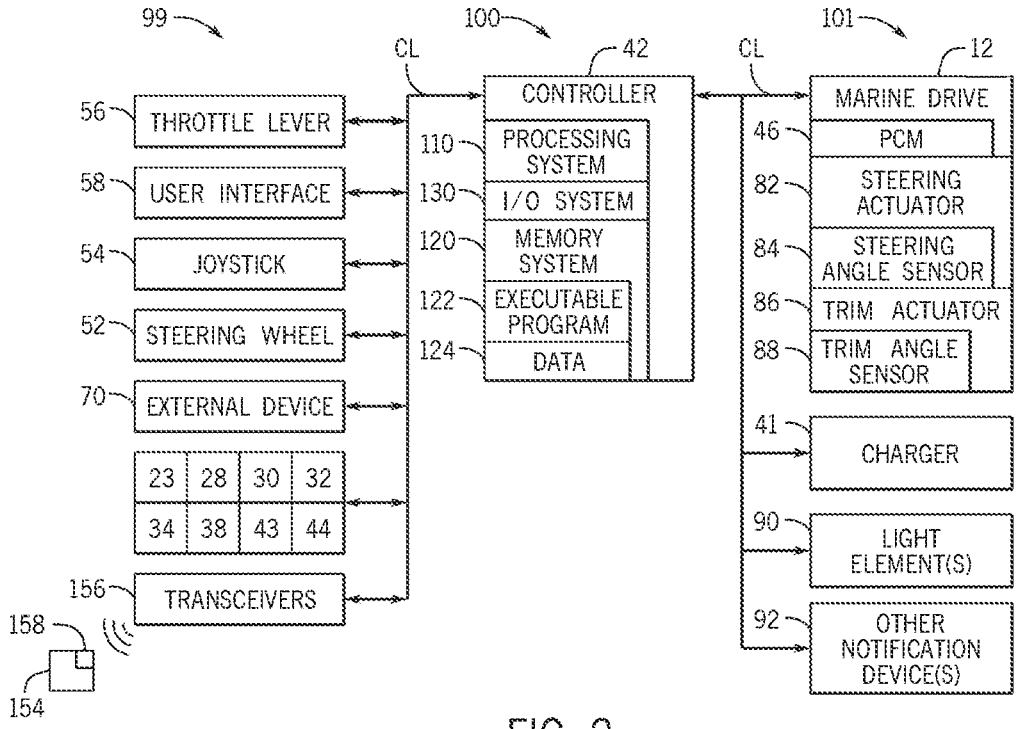
FIG. 2 is a schematic view of an example of a control system according to the present disclosure.

With reference to FIG. 2, additional information is now provided for an example of the control system 100 such as may be incorporated within the marine vessel 1 of FIG. 1. Certain examples of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the system 10 via a communication link CL, which can be any wired or wireless link. The control system 100 is capable of receiving information and/or controlling one or more operational characteristics of the system 10 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the system 10. Moreover, the communication link CL lines are meant only to demonstrate that the various control elements are capable of communicating with one another, and do not represent actual wiring connections between the various elements, nor do they represent the only paths of communication between the elements. Additionally, the system 10 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101. By way of example, the input devices 99 is shown to include different operator input devices (e.g., steering wheel 52, throttle lever 56) and the different types of sensors described above. As will become apparent, the output devices 101 include different lights 90 and other notification devices 92 such as speakers and vibration devices, as well as other components described herein. It should be noted that FIG. 2 is merely an example and not all input devices and output devices are shown. Likewise, input devices may also or alternatively function in certain cases as output devices, and visa versa for output devices functioning as input devices. By way of example, display device 58 at the helm 51 may be both an input device and an output device. Additionally, different components may communicate in a different manner than shown, and likewise components may be associated with different controllers than shown.

The processing system 110 loads and executes an executable program 122 from the memory system 120, accesses data 124 stored within the memory system 120, and directs the system 10 and the marine vessel 1 generally to operate as described in further detail below. The processing system 110 may be implemented as a single microprocessor or other circuitry or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. The memory system 120 may be implemented as a single storage device or be distributed across multiple storage devices or sub-systems that cooperate to store computer readable instructions, data structures, program modules, or other data. The memory system 120 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. By way of example, the computations described herein for preventing or minimizing cavitation oscillation may take place in a PCM and/or a motor controller.

FIG. 2 also shows other components that may be controlled by the control system 100, such as a steering actuator 82 and associated steering angle sensor 84, and a trim actuator 86 and trim angle sensor 88, each of which may be conventional and is thus not described further herein. Exemplary trim actuators and sensors are disclosed in U.S. Pat. Nos. 6,583,728; 7,156,709; 7,416,456; and 9,359,057; 10,137,971, which are incorporated by reference in entirety herein.

The control system 100 also controls the operation of one or more lights 90, as well as other notification devices 92 such as speakers, buzzers, vibration devices. By way of example, the light element 90 may comprise light emitting diodes, projectors, stationary or moveable spotlights, or electroluminescent paint, film, or coatings such as those produced by Lumilor® of Medina, Ohio. In this case, the light element 90 may be painted or applied to a portion of the marine vessel, which as described below may be on a cover that at least partially covers a component and/or region of the marine vessel, such as a section of floor (removable or fixed), a wall of the hull, a cowling of a marine drive, a seat cushion, etc. The light element 90 may be operated by controlling the energy provided thereto, as well as the color, brightness, duty cycle, and/or pattern of light generated by the light element.

In certain examples, the light element 90 can only be seen or discerned when on. In other words, a cover may appear to be completely normal or conventional when the light element 90 is off (i.e., the light element 90 is non-visible), whereby operating the light element 90 then changes the appearance of an exterior surface of the cover. As discussed above, the change in appearance may be a change in color, displaying text, symbols, graphics, and the like, and/or a change in brightness of the cover, by way of example.

Figure 3:
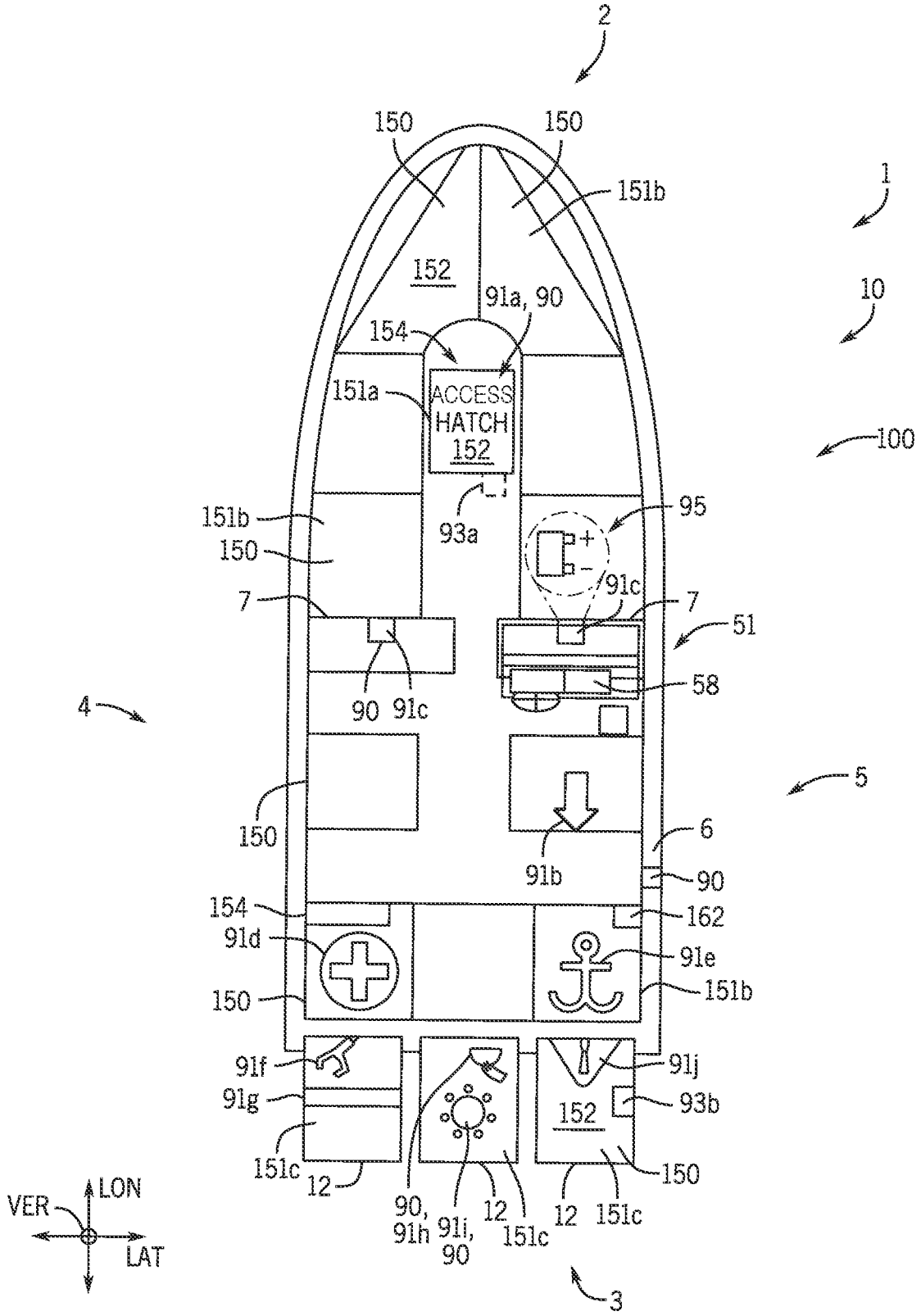
FIG. 3 is a top view of another marine vessel incorporating a system for assisting an operator according to the present disclosure.

FIG. 3 provides another view of a marine vessel 1 having a system 10 for assisting an operator of the marine vessel according to the present disclosure. The marine vessel 1 includes multiple covers 150 that each cover at least a portion of something within the marine vessel, such as a component or a region of the marine vessel. Each of the covers 150 has an external surface 152 that is visible by the operator when the cover is in place during operation (e.g., a seat cushion being positioned for sitting). Individual covers with the covers 150 are labeled with number 151 for reference. In the system 10 shown in FIG. 3, the cover 151*a* is a section of flooring that covers a region therebelow, such as a bilge, live well, or storage locker. Additional covers may be portions of the walls 6 of the hull or other structures, lids, seat cushions 151*b*, or cowlings 151*c* of the marine drives 12.

These one or more light elements 90 are operable for assisting the operator in locating components throughout the marine vessel when attention is recommended. In particular, the control system 100 (also referred to as the controller for brevity) controls operation of the light elements 90 to assist the operating in locating a component by changing the appearance of a cover 150 proximate to that component. In other words, each light element 90 is operable to change an appearance of the external surface 152 of the cover 150 associated therewith, which may be alone or in conjunction with other light elements 90.

In certain examples, the light element 90 is supported by the cover 150 itself. By way of example, the light element 90 may include one or more light emitting diodes (LED 91*b*) or light bulbs coupled to the cover. In another example, the light element 90 may include an electroluminescent paint, coating, film, or other application (each generally referred to as "electroluminscents"). In this case, the light elements 90 may be positioned on the exterior surface 152 of the cover 150.

The present inventors have identified that the system 10 provides additional advantages in that the lighting elements 90 may have low power requirements for use. As such, in some configurations the lighting elements 90 are operatively coupled to power storage devices (e.g., batteries or capacitors) and to solar panels or other mechanisms for recharging them. This advantageously allows for the light elements 90 to be provided where connecting to a central source of power, for example batteries near the stern, is inconvenient and/or cost prohibitive. In certain embodiments, the lighting elements 90 are also operatively coupled to a wireless communication device (e.g., Bluetooth LE®, WiFi, or other protocols known in the art) such that wired connections are unnecessary.

The light elements 90 may be positioned under the cover 150 and configured to shine therethrough, integrally formed within the cover, and/or applied to the external surface as described above. In certain examples, as discussed above, the light element 90 is not visible or is not readily visible (e.g., is faintly visible, visible under certain lighting, or visible only from certain angles) when off.

The light elements 90 may be configured to change the appearance of a cover 150 as text 91*a*, such as via an LED array or writing via electroluminescents. In the configuration of FIG. 3, electroluminescents are shown in the on state for labeling a cover 150 in the floor near the bow as "ACCESS HATCH" (the component being the space below the cover, or a physical item under the cover such as a valve or battery). Other examples of electroluminescents are shown to create symbols 91*d*, 91*e* that indicate which component 154 is covered by a given cover 150 (here indicating medical supplies and an anchor, respectively), as well as symbols 91*f*, 91*h*, 91*j* indicating a nature of the attention recommendation, such as relating to general service or scheduled maintenance, oil pressure or oil level, or a general alert, respectively. FIG. 3 also shows electroluminescents as light elements 90 that create geometric shapes 91*g*, 91*i* that generally raise awareness and gain the attention of the operator without indicating the component or the nature of the attention recommended. It should be recognized that these light elements 90 are not limited to merely being on or off but may be controlled to vary in color (e.g., red for safety-based attention, green for non-safety based attention), duty cycle (e.g., breathing patterns), and the like.

Other shapes, symbols, and text are also contemplated. Additionally, it should be recognized that an entire cover may be controlled to glow when the corresponding light element 90 is on, for example the entire upper portion of a cowling 151*c*. Likewise, text, symbols, and/or shapes may be provided as negative space, for example by causing the remainder of the cover 150 or a portion thereof to change in appearance such that the text, symbols, and/or shapes to be communicated remain in the form of the original cover 150.

In certain examples, the light element 90 is positioned apart from the cover 150, but nonetheless changes the appearance of the cover 150. The system 10 of FIG. 3 includes two projectors 91*c* as light elements 90, which are provided near windshields 7 at the helm 51. The projectors 91*c* are operable to project text, symbol, and/or the like, or to simply cast light, onto a proximate cover 150. In the example shown, the projector 91*c* on the port side 4 is off and thus the cover 150 just in front of the corresponding windshield 7 appears just as a cover. In contrast, the projector 91*c* on the starboard side 5 is on to thereby change an appearance of the cover 150 just in front of the windshield 7 on the starboard side 5. These two covers 150 may otherwise have the same properties as each other (being mirror images). However, it can be seen that the appearance of the cover 150 on the starboard side 5 has changed to show a battery shaped symbol 95, indicating that a battery is in the general vicinity, in this case being positioned under that cover.

FIG. 3 also shows examples of additional notification devices 92 within the system 10. In particular, a speaker 93*a* is provided proximate to the cover 151*a* in the floor near the bow 2, which may be configured to audibly announce "Please close the valve under the access hatch in the floor near the bow" when the corresponding light element 90 is on to further assist the operator in finding the component of interest. Likewise, a haptic device is positioned under the cowl 151*c* of the marine drive 12 to further assist the operator in finding the component of interest that is proximate to that cover.

As discussed above, the controller controls operation of the light elements 90 and the additional notification devices. In particular, the controller provides this control based on an input received by the controller that indicates that attention is recommended for a component within the marine vessel. The input may be received from one of the input devices 199 shown in the control system 100 of FIG. 2, such as an oil level or a temperature reading of a battery or engine being out or threshold range, the presence of water, a battery not being recognized as being connected, a valve being opened or closed, or other conventionally measured statuses. Since these inputs may be provided to the control system in a manner known in the art, further explanation as to their origin is not provided herein. By way of example, U.S. Pat. No. 9,193,429 discloses systems and methods for indicating oil levels in marine drives, and U.S. Pat. No. 8,944,865 discloses systems and methods for sensing a presence of water in a region of a marine vessel, which are incorporated by reference herein in their entireties.

When an input indicating that attention is recommended for some component within the marine vessel, the controller determines whether that component is proximate to a cover, and, proximate to a cover 150 having a light element 90 and/or additional notification device 92 corresponding thereto. By way of example, this determination may be made by reference to a data table of components and corresponding light elements 150 and/or additional notification devices stored in the memory system 120 (FIG. 2). This data table or alternative mechanism for association maybe provided with the marine vessel and/or configured by the operator. In some cases, the association of components and covers may be discerned from the nature of the input received by the control system. For example, if the propulsion control module of a marine drive is the source of the input received by the controller, the controller may automatically consider the marine drive as the component and its cowling as the cover. If the component is determined to be proximate to such a cover 150, the controller operates the light element 90 corresponding to that cover 150 to change the appearance of that cover 150, thereby assisting the operator in locating the component for which attention is recommended.

An example is now provided in which the controller receives an input indicating that the oil level for the central marine drive 12 is low. In this case, the component of interest is the oil fill port for the central marine drive 12. The controller determines that the oil fill port of the central marine drive 12 is proximate to the cowling 151*c* of the center marine drive 12, which is provided with two corresponding light elements 90. The controller therefore operates at least one of the two corresponding light elements 90 to change the appearance of the exterior surface of the cowling 151*c*, thereby visibly indicating to the operator where attention is needed.

The two corresponding light elements 90 shown for the cover 150 in proximity to the central marine drive 12 may be operated differently depending on the input received by the controller. For examples, the light element 91*i* may be turned on whenever any component associated with the central marine drive 12 is recommended to received attention, whereas the light elements 91*h* may be operated only when the recommended attention relates to oil levels and/or pressures. It should be recognized that this may vary as a function of the change in appearance provided by the light element 90, with some being more general indicators (e.g., light element 91*i*) and others being issue-specific (e.g., light element 91*h*).

The systems and methods disclosed herein are not limited to controlling light elements and/or additional notification devices to indicate when problems or potential problems arise, but also to aid the operator in finding non-problematic components of interest. For example, if an operator selects an auto-docking mode for the marine vessel, the controller may automatically control the light elements and/or additional notification devices to assist the operator in locating the fenders stored throughout the marine vessel. In this case, the operator, boat owner, or boat manufacturer may provide preset information about where these fenders and other components are positioned throughout the marine vessel, which may be stored in the member system 120 for later retrieval. This information may be stored in many different formats, whether a map of the marine vessel, or simple data table associating light elements and/or additional notification devices with corresponding components.

In certain embodiments, components 154 may be provided with RFID tags, NFC tags, or other identification devices 158 that are read by corresponding readers (e.g., transceivers 156) throughout the marine vessel to automatically locate components within the marine vessel. This may be particularly advantageous for objects that do not have fixed storage locations, such as a medical kit, scuba gear, and the like.

Figure 4:
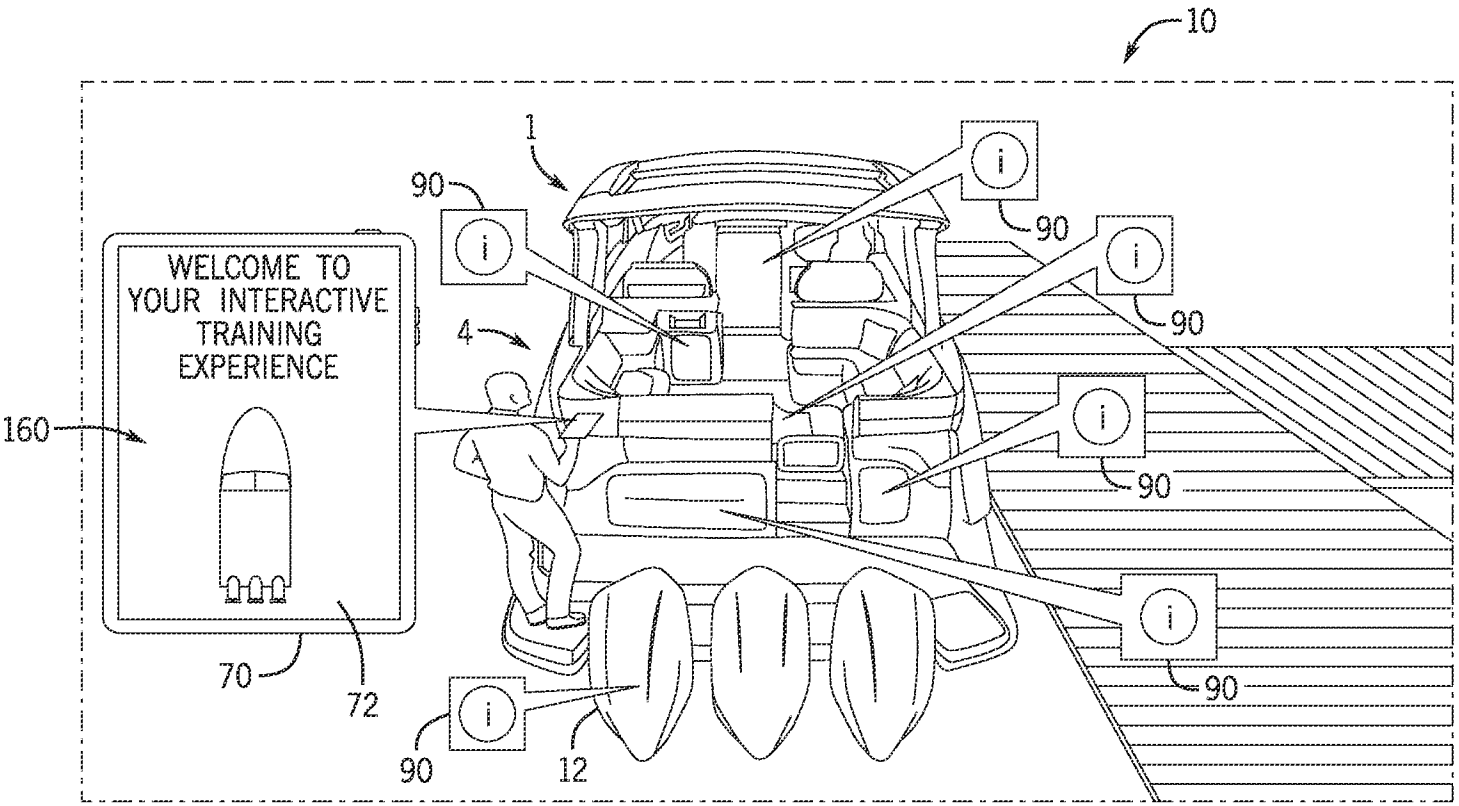
FIG. 4 is a perspective view of another marine vessel incorporating a system for assisting an operator according to the present disclosure.

In certain embodiments, the controller is configured such that the operate can inquire as to where a particular component of interest is located, such as by typing or providing a voice command via an external device 70 (FIG. 1) such as a smart phone or smart watch wirelessly paired to communicate within the control system 100. For example, the operator may provide a request for assistance by saying "Hey Sea Ray, where is the water pump?", or "where is the battery disconnect switch?" The controller then responds by causing the light elements 90 and/or additional notification devices 92 for the corresponding cover or covers 150 to operate so as to assist the operator in finding these components of interest. In further examples, as shown in FIG. 4, a map 160 of the marine vessel may also be produced on the external device 70 with the corresponding covers 150 indicated via light elements within the external device 70 itself (e.g., text, symbols, and/or colors on the displayed map).

In another case, the system 10 is configured to assist in training the operator as to the locations of key components of interest. For example, a tour may be initiated via the external device 70 in which the operator selects a component and the controller causes the corresponding cover 150 to be illuminated in real-time. In certain examples, the operator confirms that they have seen the cover for the component of interest before the tour continues on to the next component. This may be particularly helpful for new owners, renters, first responders, or guests of a marine vessel.

It should be recognized that the system 10 provides different information than that provided at the helm 51, including via the display device 58. The system 10 provides assistance at or near the actual site of the component of interest, which is often positioned away from the helm and is often difficult to find.

Figure 5:
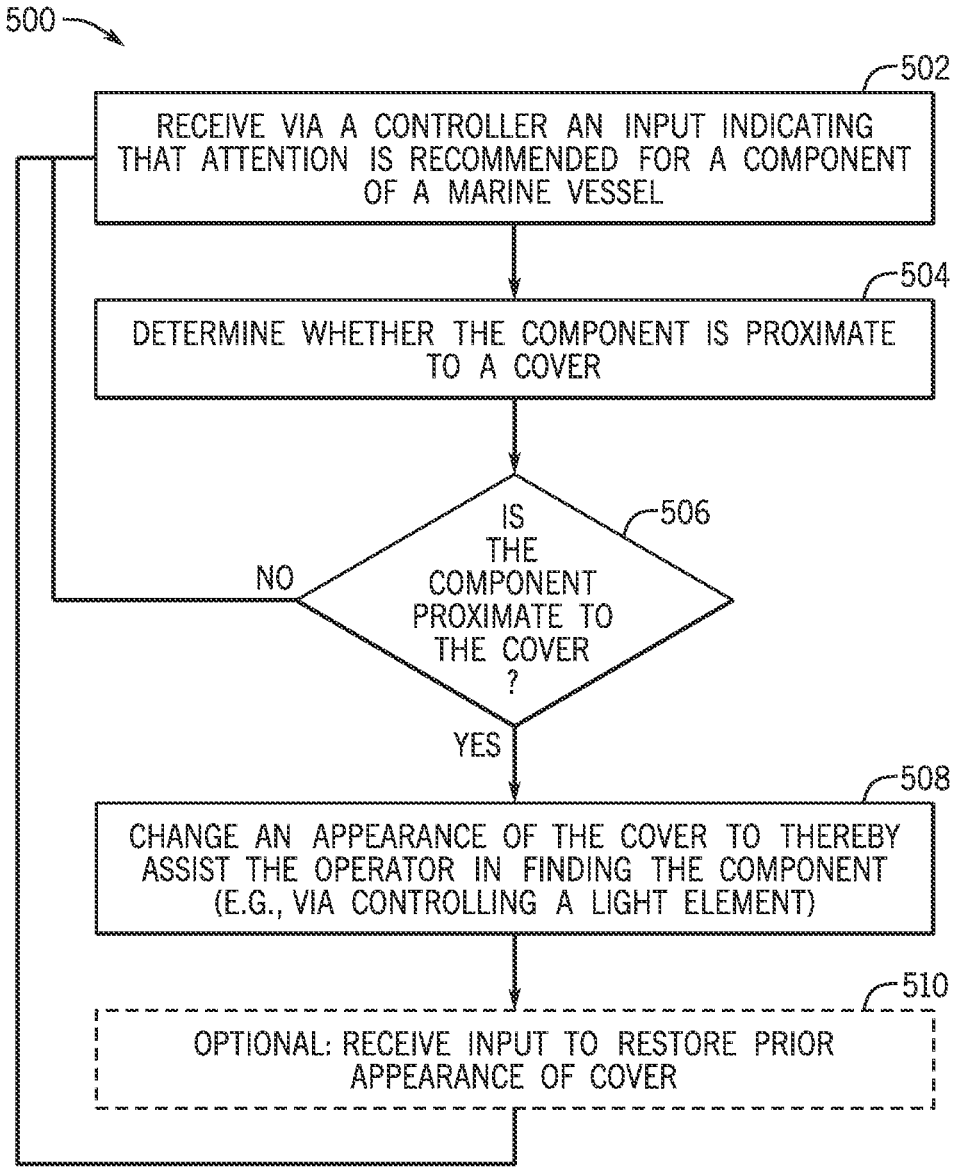
FIG. 5 is a flow chart depicting one example of a method for assisting an operator according to the present disclosure.

FIG. 5 shows one method 200 for assisting an operator of a marine vessel according to the present disclosure, which may be performed via a system such as that discussed above. As discussed above, the marine vessel has at least one cover, which is proximate a component for which attention is recommended. The method 200 provides for receiving in step 202, via a controller, an input indicating that attention is recommended for the component. This input may be provided in a conventional manner, for example as a measurement from a sensor determined to exceed a threshold. Step 204 provides for determining whether the component in which the input relates is proximate to the cover. If not, step 206 provides that the process returns to step 202 for further monitoring. However, instead the component is proximate the cover, the process continues after step 206 to step 208.

It should be recognized that the term "proximate" does not necessarily mean that the cover is covering the component, though in some cases this will be true. Rather, proximate means close enough that the appearance of the cover can be used to assist the operator in locating this component. For example, a cover may be illuminated to display an arrow pointing to the location of the component that is not hidden by the cover, but is less than 3.0 meters, less than 1.0 meter, or less than 0.5 meters away. It should be recognized that in this example the component may be hidden by another cover, but one in which that other cover is less desirable to use as the mechanism for assisting the operator. For example, the cover hiding the component may be a floor board that is not convenient to provide the necessary power to illuminate.

Step 208 provides for changing an appearance of the cover when the input is received and the component is determined to be proximate to the cover, wherein changing the appearance of the cover assists the operator in finding the component for which attention is recommended. In certain examples, an optional step 210 provides for receiving an input from the operator to restore the prior appearance of the cover from before step 208. By way of example, this may be a touch sensor 162 (see FIG. 3) operatively coupled to the cover 150 of interest such that the operator touching this cover 150 acknowledges their identification thereof, allowing the system to stop providing the indication. In other cases, the indication from the light elements and/or additional notification devices may be disabled when the underlying issue is resolved (e.g., a switch turned off, an oil level being returned to threshold range). The indications may alternatively time out automatically, cycle on a periodic basis, or be manually shut off via an external device 70.

In this manner, the systems and methods disclosed herein provide additional information not previously available to the operator, which helps to identify issues for which attention is recommended, and specifically where within the marine vessel the operator must go to do so. Likewise, the systems and methods can help an operator location a component of interest even without any issues being present, whereby the attention recommended for that component is for training or at the request of the operator.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A system for assisting an operator of a marine vessel, the system comprising:

a cover that covers a portion of the marine vessel, the cover comprising an external surface;

a light element operable to change an appearance of the external surface thereof; and a controller operatively coupled to the light element, the controller being configured to receive an input indicating that attention is recommended for a component, to determine whether the component is proximate to the cover, and, when the component is determined to be proximate to the cover, to operate the light element to change the appearance of the cover to thereby assist the operator in locating the component for which attention is recommended.

2. The system according to claim 1, wherein the cover is a cowling of a marine drive configured to propel the marine vessel and the component is at least partially inside the cowling.

3. The system according to claim 1, wherein the light element is supported by the cover.

4. The system according to claim 1, wherein the light element is visible on the external surface when on and non-visible on the external surface when off.

5. The system according to claim 1, wherein the controller is configured to turn on the light element when the input corresponds to an overheating temperature detected on the marine vessel.

6. The system according to claim 1, wherein the controller is configured to turn on the light element when the input corresponds to an operator request for assistance locating the portion of the marine vessel covered by the cover.

7. The system according to claim 6, wherein the controller is configured to receive the operator request wirelessly from an external device.

8. The system according to claim 1, wherein the external surface is positioned apart from a helm of the marine vessel.

9. The system according to claim 8, further comprising a display device positioned at the helm, the display device being operatively coupled to the controller, the controller being configured to cause the display device to generate a display when the input relating to the portion of the marine vessel covered by the cover is received.

10. The system according to claim 9, wherein the display generated by the display device provides different information than the appearance of the external surface of the cover from the light element.

11. The system according to claim 1, wherein the cover is a removable section of flooring.

12. The system according to claim 1, wherein the appearance of the external surface changes in color via operating the light element.

13. The system according to claim 1, wherein the appearance of the external surface changes by displaying text via operating the light element.

14. The system according to claim 1, wherein the appearance of the external surface changes in brightness via operating the light element.

15. The system according to claim 1, further comprising a speaker and/or vibration device operatively coupled to the controller, the controller being configured to cause the speaker to produce a sound and/or the vibration device to generate vibration when the input is received and the component is determined to be proximate to the cover.

16. The system according to claim 1, wherein the controller is configured to receive the input from a sensor that measures at least one of temperature, pressure, smoke, electrical resistance, voltage, current, vibration, a presence of liquid, and a level of liquid.

17. A method for assisting an operator of a marine vessel, the marine vessel having a cover proximate to a component of the marine vessel, the method comprising:

receiving via a controller an input indicating that attention is recommended for the component;

determining whether the component is proximate to the cover; and changing an appearance of the cover when the input is received and the component is determined to be proximate to the cover, wherein changing the appearance of the cover assists the operator in finding the component for which attention is recommended.

18. The method according to claim 17, wherein the appearance of the cover is changed by changing a brightness produced via a light element.

19. The method according to claim 17, wherein the component is one or a plurality of components, the cover is one of a plurality of covers that at least partially cover the plurality of components, respectively, and wherein the appearances of the covers within the plurality covers are changed via controlling a plurality of light elements associated therewith, respectively.

20. A system for assisting an operator of a marine vessel having a helm, the system comprising:

a first cover that covers a first region away from the helm;

a second cover that covers a second region away from the first region and from the helm, the first cover and the second cover each comprising an external surface;

light elements positioned proximate the first cover and the second cover, respectively, and operable to change an appearance of the external surface corresponding thereto; and a controller operatively coupled to the light elements, the controller being configured to receive an input indicating that attention is recommended for one of the first region and the second region, to determine for which of the first region and the second region the attention is recommended, and to control one of the light elements to change an appearance of the external surface of one of the first cover and the second cover covering the one of the first region and the second region for which the attention is recommend, wherein changing the appearance assists the operator in locating the one of the first region and the second region for which the attention is recommend.

* * * * *